US007601473B2

(12) United States Patent
Lofftus et al.

(10) Patent No.: US 7,601,473 B2
(45) Date of Patent: Oct. 13, 2009

(54) TONER

(75) Inventors: Kevin D. Lofftus, Fairport, NY (US); Satyanarayan Srinivsan, Pittsford, NY (US); David D. Putnam, Fairport, NY (US); Peter S. Alexandrovich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 476 days.

(21) Appl. No.: 11/474,018

(22) Filed: Jun. 23, 2006

(65) Prior Publication Data

US 2007/0298343 A1 Dec. 27, 2007

(51) Int. Cl.
*G03G 9/00* (2006.01)

(52) U.S. Cl. ..... 430/108.6; 430/108.7; 430/111.1

(58) Field of Classification Search ..... 430/108.6, 430/108.7, 111.1
See application file for complete search history.

(56) References Cited

U.S. PATENT DOCUMENTS 5,066,558 A 11/1991 Hikake et al.
6,087,057 A 7/2000 Hikata et al.

*Primary Examiner*—Mark A Chapman
(74) *Attorney, Agent, or Firm*—Carl F. Ruoff; Andrew J. Anderson

(57) ABSTRACT

The invention relates to a developer for developing electrostatic images. The developer includes magnetic carrier particles at a loading of from 60 to 99 weight percent of the developer. Toner particles are at a loading of 1 to 40 weight percent of the developer. The toner particles include a resin core particle having an outer surface and 0.05 to 5 weight percent a first metal oxide powder is substantially fixed to the outer surface. The toner particles further include 0.05 to 2 weight percent of a second metal oxide powder that is substantially free to transfer between outer surface of the toner particles and an outer surface of the magnetic carrier surface.

21 Claims, 2 Drawing Sheets

TONER

FIELD OF THE INVENTION

The present invention relates to toners for electrophotography. The present invention provides improved toner performance through improved surface treatment.

BACKGROUND OF THE INVENTION

Surface forces and charging properties of toners are modified by application of surface treatments. The most common surface treatments are surface modified fumed silicas, but fine particles of titania, alumina, zinc oxide, tin oxide, cerium oxide, and polymer beads can also be used. Surface treatment may serve other functions such as providing cleaning aids to ancillary processing in an electrophotographic process. The function of reducing the forces is achieved by separation of the toner from other surfaces by the very small surface treatment particles. The attractive Van der Waals forces between toner particles and other surfaces decrease as $(D/s)^2$ where D is the toner diameter and s is the separation at the closest point between the toner and the other surface and s<<D. A few points of contact between the other surface and the toner created by the surface treatment increase the separation between the surfaces. The contacts of the surface treatment with the toner and another surface add a small attractive force. As such, the ideal situation is for the surface treatment to be uniformly dispersed on the toner with a minimum coverage to affect the desired separation given the curvature of the toner and the size of the surface treatment.

The reduction of attractive forces exerted on a toner enhances processes where the toner particles must move. Some processes that benefit from lower adhesive and cohesive forces are toner powder flow in the replenisher, mixing of toner in the developer station, development of toner onto the latent image, transfer of the image to intermediate and final receivers and cleaning of residual images from photoconductors and intermediate receivers. In these processes, the attractive forces are overcome by gravity, mechanical, inertial and electrostatic forces. Often, some cohesive force of the toner is beneficial and an optimum separation of the toner particles from other surfaces exists. These other forces are used to move the toner from the developer to the latent image and transfer the image from the photoconductor to intermediate and final receivers. Like Van der Waals forces, electrostatic forces scale with $D^2$. The other forces scale with $D^3$ and are less effective at moving smaller toner hence the greater need to reduce the Van der Waals forces for smaller toner.

Toner is often exposed to violent collisions and shearing motion to induce a static charge on the toner, to develop latent images on photoreceptors with toner, to transfer the developed images to intermediate and final receivers, and in other ancillary processes involving toner such as cleaning. Violent collisions of the toner particle normal to the surface of the toner direct the impulse force on the surface treatment. The impulse force can exceed the strength of the toner core material (usually a melt adhesive polymer with a glass transition temperature, Tg, in the range of 50 to 60 degrees centigrade). The kinetic energy of the collision is transformed into heat and, because of the short duration of the collision event, the heat is localized at the surface treatment contact points with the toner particle and other surface. The local temperature at the contact briefly exceeds the Tg and the toner core material will plastically deform around the surface treatment increasing the area of contact. Because the separation in this area of contact is on the atomic scale, the attractive forces between the surface treatment and the toner are greatly increased. When this attractive force exceeds the shearing forces applied in the system, the surface treatment is tacked to the toner surface. The area of contact required to achieve a tacked state depends upon the chemistry of the toner and the surface treatment and is highly sensitive to chemical modifications of the outer surface of the surface treatment. Further impaction will continue to embed the toner and in extreme cases, the surface treatment will be pushed into the toner until it is flush with the surface. Further impaction works the toner core material in plastic deformation covering over and engulfing the surface treatment. As the surface treatment becomes increasingly embedded and engulfed, it is less effective at maintaining the desired separation between the toner particle and other surfaces.

Before the surface treatment becomes tacked, shearing motions may move its position on the toner surface. The movement reduces the spacing and may allow contact of the core material of the toner particle with another surface. With sufficient shearing, the surface treatment will be concentrated in low (concave) areas of the toner surface necessitating an initial excess of surface treatment to obtain the desired separation. During gentle collisions and shearing contacts, some of the surface treatment may transfer to other surfaces. This reduces the effectiveness of the surface treatment and may create problems associated with the other surface. For example, transfer of the surface treatment to the carrier surface in a two component system may change the internal coefficient of friction resulting changes in packed density and flow characteristics. Control of packed density of the developer is important because many toner concentration control algorithms rely upon changes in magnetic density as a function of toner concentration to measure the concentration for feedback control.

Tacking the surface treatment in place once uniformly dispersed on the toner surface under controlled conditions with low shear allows the use of lower surface treatment concentrations to achieve the desired separation. Tacking will also prevent transfer of the surface treatment to other surfaces. However, the tacking initiates the embedment process and reduces the number of impacts a toner particle may sustain before the surface treatment becomes ineffective at maintaining the desired separation from other surfaces. Large surface treatment may sustain many more impacts before embedment reduces the effectiveness. As the size of surface treatment particles increase, the area of contact increases and the energy collisions must increase to bring the localized temperature above the Tg required for increasing the degree of embedment.

Many surface treatments have several states of agglomeration. Deagglomeration and dispersion of silica is required in the manufacturing step of applying the surface treatment to the toner. Some agglomerates that can be dispersed in the toning process may be left as a reservoir to replace surface treatment that becomes lost due to engulfment or transfer to other surfaces. However, several problems exist with this approach. First, these agglomerates are rapidly lost to other surfaces and aggravate the problems described above. Second, the rate of deagglomeration is difficult to match with the rate of embedment. Third, agglomerates that have significant life times in the electrophotographic process are difficult to disperse uniformly on the toner surface in the manufacturing process. Last, large agglomerates will cause voids in the image.

The surface treatment may be tacked in place during manufacturing by high mechanical forces to induce sufficient temperature rise at the contact points between the surface treatment and the toner particle. Some mechanical devices generate the intense mechanical force by compressive shearing of a packed toner bed between a moving tools and a stationary wall. A high degree of shear rapidly heats the toner increasing the rate of tacking but also displacing some of the surface treatment into the low lying areas of the toner surface reducing the effectiveness of the surface treatment. Other devices rely upon toner-toner collisions in a fluidized bed to disperse the surface treatment. These collisions produce much lower shear and are more effective in achieving uniform dispersions. However, the normal forces are also lower and tacking is difficult to obtain.

The collision energy required to tack the surface treatment may be reduced by increasing the temperature of the fluidized bed. At elevated temperature, less kinetic energy from collisions is required to generate sufficient heat at the contact point with the surface treatment to exceed the Tg. Untacked but well dispersed surface treatment may be tacked under no shear by heating the toner. The attractive forces between the surface treatment and the toner core particle will cause the core material to plastically deform when near or above the Tg. Given sufficient time to increase the contact area between the surface treatment and the core material to the point of tacking but not to engulf the particle, a uniform tacked surface treatment can be obtained. The surface treatment prevents the toner from fusing together and the few points of surface treatment contacting two core particles are easily broken by sieving and subsequent action in the developer station.

Tacking of the surface treatment may be obtained in a wide variety of devices from sheared bed devices such as a Cylcomix (Hosokawa Micron Powder Systems) with no heat to static beds in ovens. Other devices that form beds and powder clouds with particle-particle collisions can provide tacking when appropriate heat is applied. Devices that form powder clouds with high collision energies such as jet mills or forced vortex classifiers (100ATP from Hosokawa Micron Powder Systems) need little or no heat for tacking of the surface treatment. Stirred bed devices such as Henschel mixers require temperatures ranging from 15° C. less than the Tg to the Tg depending upon the intensity of the mixing, the size and density of the toner, and the chemistry of the surface treatment.

Providing a well-dispersed surface treatment to separate the core toner from other surfaces may cause other problems. One problem is the reduction in the frequency of contacts with a charging surface such as a developer roll doctor blade in single component developers or a carrier in two component developers. The reduced contact frequency decreases the charging rate toner. To compensate, the surface treatment is modified with a chemical surface treatment to enhance charging of the particulate surface treatment. The charging of three component systems is poorly understood.

In the fully tacked state, charging of surface treated toner becomes a two-component system with a very heterogeneous toner surface. Initially, tribocharging is dominated by the surface treatment charging against the carrier or doctor blade. As surface treatment is embedded by mixing in the toning station, the dominant tribocharging mechanism transitions to that of the core toner charging against the carrier or doctor blade. Because of the transition in dominant charging mechanism with increased embedment, the charge level and humidity sensitivity varies with the degree of embedment. These changes in charging behavior may directly affect packed density through electrostatic forces and decrease the packed density due to increased Van der Waals forces at smaller separations for higher embedment. Higher Van der Waals forces between particles result in a less free flowing powder and thus decreased bulk density when the toner surface treatment has become embedded.

The average degree of embedment varies with the residence time of the toner in a process. The longer the toner is in a process, the more collisions it undergoes and the greater the embedment. The residence time varies in a toning station is inversely proportional to the image content of the documents being printed with that toner. As a result, the tribocharging properties may vary significantly with customer job stream.

The tribocharging becomes more complex for toners with surface treatment in the untacked state. Three two-component tribocharging mechanisms must be considered: core toner charging against the carrier or doctor blade, surface treatment charging against the carrier or doctor blade, and charging between the core toner and surface treatment. The surface treatment may be transferred to the carrier or doctor blade leaving a charge on the toner. It may also be back transferred to the toner leaving behind a charge on the carrier or doctor blade. Rapid transfer of surface treatment between toner and carrier may facilitate rapid charging. Transfer of surface treatment between toners particles may facilitate rapid charge transfer between toners increasing the charge of the lower toner while reducing that of the higher charged toner.

Two mechanisms of rapid charge transfer are possible. First, the mobility of the surface treatment provides mobility to the charge itself. Second, the kinetics of charge exchange may be increased resulting in a reduced propensity of the replenishment toner to dust out of the developer. The rate of charge exchange tends to be faster for components that are close to one another in a triboelectrification ranking. The chemistry of the surface treatment may be adjusted so that its tribo-level in a triboelectrification series is in between that of the toner and the carrier or doctor blade. When this is the case, the mean time of charge exchange between the toner and the surface treatment plus that between the surface treatment and carrier or doctor blade is less that that between the toner and carrier of doctor blade. Tacking and embedding the surface treatment will negate this rapid charge transfer.

One of the purposes of separating the toner surface from another surface is to prevent mass transfer of toner material to the charging surface of the carrier or doctor blade. As mass is transferred to the charging surface, it becomes closer to the toner in the triboelectrification properties and both the charge rate and level decrease resulting in a increased propensity of the replenishment toner to dust out of the developer. Two extremes of this mass transfer exist. When the surface treatment is highly embedded, the core material will be transferred and tribocharging is dominated by the differential rate of transfer of components from the core. At the other extreme is when excess surface treatment is used so that the core toner never contacts the carrier or doctor blade surface. At these levels of surface treatment, it is difficult for all of the silica to become tacked and surface treatment transfers to the charging surface. Because of the high level of surface treatment on the toner, back transfer of surface treatment to the toner is slow until the surface concentration of surface treatment on the charging surfaces approaches that of the toner. In this state, most of the collisions occur between surface treatment on the toner and surface treatment on the carrier or doctor blade and no charge is exchanged. Mass transfer of chemically reactive components from the core toner may also result in the loss of charging ability by the carrier or doctor blade.

Another purpose of separating the toner surface from another surface is to reduce the Van der Waals and electrostatic forces between the toner and the charging surface. Reduction of these forces allows greater exchange of toner to enhance charging rate and greater development rates of the image. The degree of separation must be controlled so that the attractive forces are greater then mechanical forces to prevent dusting from the development station.

Yet another purpose of separating the toner surface from another surface is to modulate the adhesive and cohesive forces in transfer of the toned image. Theses forces are minimized at a high degree of separation with uniform surface treatment. As the surface treatment is embedded these forces increase. At low forces, the transfer from the photoconductor to intermediate and final receivers is enhanced. However, the reduction in cohesion between toner particles allows the repulsive forces of the charge on the toner to push the toner particles apart upon transfer. The result is a large extent of dot explosion in halftone images and in satellites in text images. Embedment increases the adhesive and cohesive forces improving dot integrity and reducing satellites but reduces transfer efficiency. The variability in transfer of halftone and continuous tone images is increased and becomes visible as granularity. The high degree of variability induced in the state of the surface treatment by variability in toner residence time in the toning station as the image content varies leads to inconsistent image quality.

U.S. Pat. No. 5,066,558 teaches the use of a three-step process first to disperse a silica powder on a resinous core toner particle in a lower energy device, second to embed the silica in a second higher energy device such that there are little or no visible silica particles on the surface by SEM, and third to disperse additional silica powder in a device similar energy to that used in the first step. The method pertains to developers of 100 wt % toners and as such does not address issues of toner concentration control.

U.S. Pat. No. 6,087,057 teaches the use of two treated silica powders where the first silica powder is treated with an alkyl silane and an amino alkyl silane to give a negative charge and the second silica powder is treated with an organopolysiloxane that charges positive relative to the first and an third metal oxide to adjust charge. These formulas are selected solely for tribocharge stability upon admix, relative humidity changes, etc.

An object of the present invention is to provide a toner that mitigates print image degradation due to poor developer performance caused by changes in the degree of surface treatment embedment.

It is an object of the invention to provide toner with rapid mixing and charging resulting in developers that have low dust and provide uniform images resulting in reduced maintenance and service costs.

It is another object to provide toners that resist transfer of components from the toner to the surface there by providing long developer life, developer flow stability, and stable toner concentration control.

It is another object to provide toners that resist changes in the degree of surface treatment embedment with changes in residence time caused by changes in image content of print jobs.

It is a further object to provide means by which the charging level and the balance of charge and forces surface may be independently optimized using a single processing step during surface treatment.

These and other objects of the invention are described below.

SUMMARY OF THE INVENTION

The invention relates to a developer for developing electrostatic images. The developer includes magnetic carrier particles at a loading of from 60 to 99 weight percent of the developer. Toner particles are at a loading of 1 to 40 weight percent of the developer. The toner particles include a resin core particle having an outer surface and 0.05 to 5 weight percent of a first metal oxide powder that is substantially tacked to the outer surface. The toner particles further include 0.05 to 2 weight percent of a second metal oxide powder that is substantially free to transfer between the outer surface of the toner particles and the outer surface of the magnetic carrier.

Figure 1A:
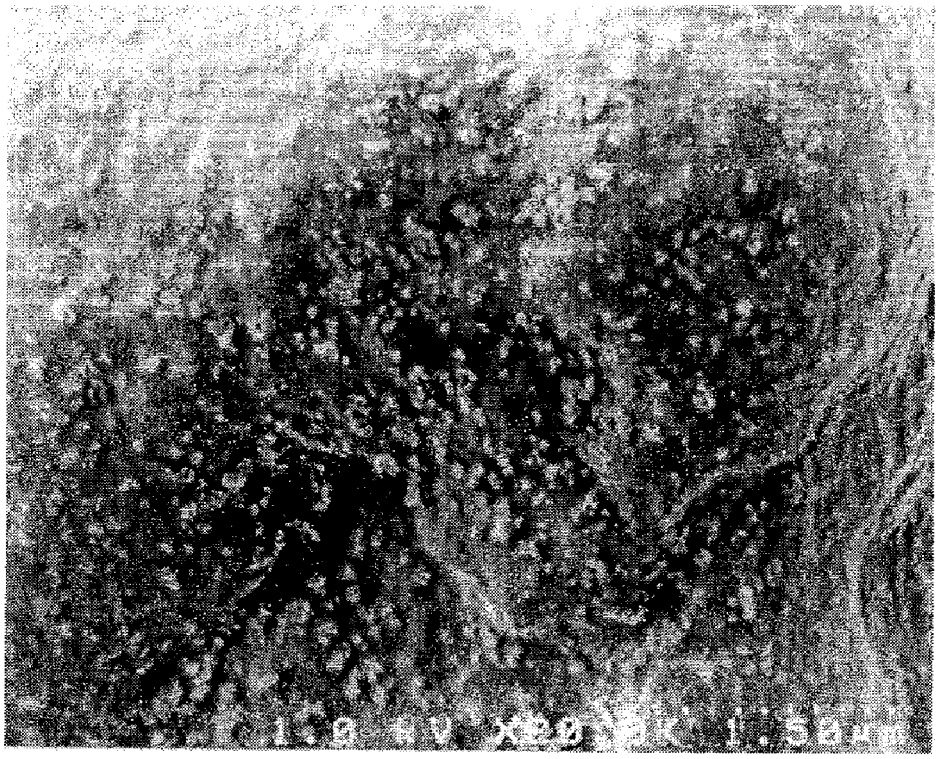
FIG. 1*a* is an SEM photomicrograph after mixing toner with a surface treatment wherein the surface treatment is in a free state and has been reduced by transfer upon mixing with a spherical polymer bead.

For a better understanding of the present invention together with other advantages and capabilities thereof, reference is made to the following description and appended claims in connection with the preceding drawings

DETAILED DESCRIPTION OF THE INVENTION

Toners used in color electrographic printers are typically polymeric particles of approximately 6 to 8 microns volume average particle size, containing dispersed colorants, charge control agents, waxes, and other addenda.

Preferably, the toner includes a binder, and optionally includes a colorant, a charge control agent, and an anti-blocking agent, which can be blended to form toner particles. Binders can be selected from a wide variety of materials, including condensation polymers such as polyesters as well as both natural and synthetic resins and modified natural resins, as disclosed, for example, in U.S. Pat. No. 4,076,857. Other useful binders can include the crosslinked polymers as disclosed in U.S. Pat. Nos. 3,938,992 and 3,941,898. The crosslinked or noncrosslinked copolymers of styrene or lower alkyl styrenes with acrylic monomers such as alkyl acrylates or methacrylates may also be used. Numerous polymers suitable for use as toner resins are disclosed in U.S. Pat. No. 4,833,060. Consequently, the teachings of U.S. Pat. Nos. 3,938,992; 3,941,898; 4,076,857; and 4,833,060 are hereby incorporated by reference in their entirety. In addition, another desired binder is a bis-phenol based polyester of the acid value between 1 and 40. The toner typically comprises 85 to 95 weight percent by weight of the binder. Such a binder can be propoxylated bisphenol-A combined with fumaric acid.

Optionally, the binder can be compounded with a colorant, i.e., a dye or pigment, either in the form of a pigment flush (a special mixture of pigment press cake and resin well-known to the art) or pigment-resin masterbatch, as well as any other desired addenda known to the art. If a developed image of low opacity is desired, no colorant need be added. Normally, however, a colorant can be included and it can, in principle, be any of the materials mentioned in *Colour Index*, Vols. I and II, 2nd Edition (1987) or Herbst and Hunger, *Industrial Organic*

*Pigments,* 4th edition (2004). Carbon black can be especially useful while other colorants can include pigment blue, pigment red, and pigment yellow. Specific colorants can include copper phthalocyanine having a CI colour index P.B.15:3, metal-free phthalocyanine P.B.16, chlorinated and bromated copper phthalocyanines such as P.G. 7 and P.G. 36, triarylcarbonium blue pigments such as P.B.61, dioxazine violet pigments such as P.V.23 calcium, laked monoazo BONA class pigments such as P.R. 57:1, 2,9-dimethylquinacridone P.R.122, Napthol red pigments such as P.R. 146, β-Napthol red and orange pigments such as P.R. 53:1 and P.O. 5, Benzimidazolone pigments such as P. R. 180, diazo pigments such as P.Y.12, P.Y 13, P.Y. 83, and P.Y. 93, and isoindoline pigments such as P.Y. 139 and P.Y. 185. The amount of colorant, if used, can vary over a wide range, e.g., from about 1 to about 25, and preferably from about 3 to about 20 weight percent of the toner component. Combinations of colorants may be used as well.

The toner can also contain charge control agents. The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patents. 1,501,065 and 1,420,839, the teachings of which are incorporated herein by reference in their entirety. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts. A particular example of an iron organo metal complex is T77 from Hodogaya.

Furthermore, quaternary ammonium salt charge agents as disclosed in Research Disclosure, No. 21030, Volume 210, October 1981 (published by Industrial Opportunities Ltd., Homewell, Havant, Hampshire, PO9 1EF, United Kingdom) may also be used. Specific charge control agents can include aluminum and/or zinc salts of di-t-butylsalicylic acid. Additional examples of suitable charge control agents include, but are not limited to, acidic organic charge control agents. Particular examples include, but are not limited to, 2,4-dihydro-5-methyl-2-phenyl-3H-pyrazol-3-one (MPP) and derivatives of butylsalicylic MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoromethylphenyl)-3H-pyrazol-3-one and the corresponding zinc salts derived there from. Other examples include charge control agents with one or more acidic functional groups, such as fumaric acid, malic acid, adipic acid, terephathalic acid, salicylic acid, fumaric acid monoethyl ester, copolymers of styrene/methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide.

Preferably, the charge control agent is, if used, provided in an amount of about 0.2-about 5% wt. of the total toner weight and preferably in an amount of about 1-about 3 weight percent of total toner weight.

The toner can optionally contain other additives, such as anti-blocking agents and/or waxes, such as polypropylene, polyethylene, or copolymers and blends thereof.

The terms "surface treatment" or "external additive" are typically used to describe such a toner formulation ingredient that is a fine particulate which is added after the core toner particle has been prepared. The most commonly used surface treatment agent on toner is fumed silica, especially hydrophobic silica. Fumed silica is available in a range of primary particle sizes, which is typically measured rather as the specific surface area by the BET nitrogen adsorption method. The surface area equivalent size is size divided by the product of the surface area and the density. The smallest available fumed silica materials have a BET surface area of about 400 $m^2/g$ corresponding to silica particle of about 7 nm in size, while the largest available materials have a BET surface area of about 50 $m^2/g$. As a general rule, the smaller the primary particle size of the silica (the higher the BET surface area), the more free-flowing will be the resulting surface treated toner for a given weight percent of silica added. We have found that the largest fumed silica materials at about 50 $m^2/g$ BET surface area corresponding to silica particle of about 55 nm in size have a reduced effectiveness as a flow aid for toner and this size defines the onset of functioning as a surface treatment. The smallest fumed silica materials become more difficult to disperse and provide very high charge levels. Surface treatment levels of that give good charging characteristics often fail to provide good flow properties. The preferred range for a balance of flow and charging properties is 100 to 250 $m^2/g$ or about 11 to 27 nm primary particle size.

An organic coating is typically applied to the fumed silica in order to cover surface silanol groups in order to render the silica hydrophobic. Common coatings include silicone fluid also known as polydimethylsiloxane (PDMS), hexamethyldisilazane (HMDS), and dimethydichlorolsilane (DMDCS) and other alkyl silanes. Such materials are available commercially from vendors including Degussa, Cabot and Wacker. Hydrophobic silicas including a first silica having a BET surface area of 130 $m^2/g$ corresponding to silica particle of about 21 nm in size, coated with DMDCS such as Aerosil R972 made by Degussa Corporation that reported a BET of 130 $m^2/g$ but a size of 16 nm measured by microscopy for this product, and a second silica having a BET of 200 $m^2/g$ corresponding to a particle size of about 14 nm coated with PDMS such as Aerosil RY200 made by Degussa Corporation which reported a BET of 200 $m^2/g$ but a size of 12 nm, have been found particularly useful as a toner surface treatment agents.

The propensity of a surface treatment to tack is related to the difference in surface energy between that of the surface treatment and that of the toner. Surface treatments having surface energies lower than that of the toner will tack and embed more slowly. A typical polymer used for toner will have a surface energy between 40 and 55 ergs/$cm^2$ while that of the surface treatment can vary from less than 30 to greater than 60 ergs/cm$^2$. The surface treatment may become engulfed in the polymer when its surface energy is greater than that of the toner polymer. The surface energy of surface treatments can be assessed by the concentration of methanol in water at which the dry powder will wet, a standard technique known as the methanol wettability test.

The surface energy may also be evaluated as the rate of the tacking and embedment that increases as the energy of mixing is increased, or by the degree of transfer of the surface treatment to another surface. Embedment rates can be monitored by a surface assay for the surface treatment such as ECSA for toner stripped from two component developers as a function of aging time. One must account for the loss a free surface treatment to the surface of the carrier. In practice, this loss can be made small by using a large toner surface area to that of the carrier and if embedment occurs, the surface treatment will back transfer to the toner. While these transfer effects make rate calculations difficult, one can use this type of test to rank surface treatments based upon the propensity to tack and embed.

Table 1 shows the results of such a test for varying surface treatments. Six toners were made by surface treating a polyester based core toner with 1% of six different silicas by mixing 15 g of toner and 0.15 g of silica in a Waring Laboratory Blender for 10 s at 6000 RPM followed by 20 s at 1960 RPM. Developers were made with these toners at 10% toner concentration using a 22 μm strontium ferrite carrier coated with 1.25% polymethylmethacrylate. Samples of the developers were aged by exercising on a 2 inch stationary roll with a 12 pole magnetic core spinning at 1000 RPM for different lengths of time. The toner was then recovered using bias development by applying a negative bias voltage to the roll while engaging a grounded 6 inch rotating drum from which the developed toner was recovered with a scraper blade. The embedment of silica for each sample was evaluated by Electron Spectroscopy Chemical analysis (ESCA). It was found that the silica embedment rate followed the surface energy measured by the methanol wettability test with lower surface energies giving slower embedment rates. The silica types are ranked from slowest to fastest as PDMS coated silica (Degussa RY200 and RY300), HMDZ coated silica (Degussa RX300), DMDCS (Degussa R972), and uncoated silica (Degussa Aerosil 200 and 300).

TABLE 1

| Source | Degussa | Degussa | Degussa | Degussa | Degussa | Degussa |
|---|---|---|---|---|---|---|
| Type | R972 | Aerosil 200 | RY200 | Aerosil 300 | RX300 | RY300 |
| Treatment | DMDCS | None | PDMS | None | HMDZ | PDMS |
| m$^2$/g | 130 | 200 | 200 | 300 | 300 | 300 |
| size nm | 21 | 14 | 14 | 9 | 9 | 9 |
| ergs/cm$^2$ | 34 | >59 | 29 | >59 | 32 | 29 |
| Aging Time min. | Atomic % Si by ESCA for toners treated at 1% | | | | | |
| 0 | 11.6 | 10.6 | 9.2 | 10.9 | 15.6 | 6.6 |
| 0.5 | | | | | | 12.9 |
| 2 | 7.1 | 7.8 | 11.2 | 8.0 | 12.1 | 12.5 |
| 5 | | | 9.5 | | 10.5 | 11.5 |
| 10 | 5.0 | 5.6 | | 5.5 | | |
| 30 | | | 7.2 | | 5.9 | 8.8 |
| 60 | 2.7 | 3.1 | 6.2 | 3.1 | 4.2 | 7.6 |

The temperature at which the test is conducted may be increased to assess tacking of surface treatments with lower surface energies. Tables 2A and 2B show the effects of temperature on the transfer of a free silica of different surface energies. Samples 2A, 2B, and 2C were processed in a 75 L Henschel mixer at 1745 RPM for the conditions listed for the same core toner used to make samples in Table 1. Samples of 2C were further process in 10L Henschel mixer at 3000 RPM to obtain samples 2D and 2E. Sample 2E was stopped short of the desired time when the cooling capacity was no longer able to keep the toner temperature at 56° C. Developers were made for each sample at 10% toner concentration using a 22 μm strontium ferrite carrier coated with 1.25% mixture of polyvinylidene fluoride and polymethylmethacrylate. Five grams were placed in a 4 dram vial and held next to a 12 pole magnetic core spinning at 2000 RPM for 15 seconds. The developer charge-to-mass was and this carrier from this measurement was analyzed by ESCA. The remaining developer was placed on a stationary roller with a 12 pole magnetic core and bias stripped of toner using a ground shell with 4000V applied to the roller while running at 2000 RPM for 1 minute. The stripped carrier was rebuilt at 10% toner concentration and the process repeated for a total of 6 cycles. Processing the toner with the higher surface energy silica R972 for 25 minutes at 42° C. (Sample 2B) resulted in complete tacking of the silica as judged by no silica being transferred to the carrier, while processing the lower surface energy silica RY200 at similar conditions only resulted in a partial tacking as judged by less silica being transferred to the carrier with this Sample 2D than with Sample 2C, that was processed at 20° C. Processing at the mid point of toner glass transition temperature Tg was necessary for complete tacking of the RY200. It is seen that there thus exists a surface treatment processing condition where a first higher surface energy type of silica can be substantially tacked to the toner surface (R972 in this example) while a second lower surface energy type of silica remains free to move and transfer to other surfaces (RY200 in this example). Our discovery that superior toner performance results when both types of silica are included in a toner processed at such a surface treatment condition is illustrated in the inventive examples that follow.

TABLE 2A

| | Surface Treatement | | | Process Conditions | | | |
|---|---|---|---|---|---|---|---|
| Toner | Type | ergs/ cm$^2$ | Level | Scale | Kg | Time | Temperture |
| 2A | R972 | 34 | 1.0% | 75 L | 15 | 2.5 min | 20 C. |
| 2B | R972 | 34 | 1.0% | 75 L | 20 | 25 min | 42 C. |

TABLE 2A-continued

| | Surface Treatement | | | Process Conditions | | | |
|---|---|---|---|---|---|---|---|
| Toner | Type | ergs/ $cm^2$ | Level | Scale | Kg | Time | Temperture |
| 2C | RY200 | 29 | 1.0% | 75 L | 20 | 10 min | 20 C. |
| 2D | RY200 | 29 | 1.0% | 10 L | 2 | C + 30 min | 42 C. |
| 2E | RY200 | 29 | 1.0% | 10 L | 2 | C + 14 min | 56-60 C. |

TABLE 2B

| | Atomic % Silica on Carrier by ESCA | | | | | | | |
|---|---|---|---|---|---|---|---|---|
| | Aging Cycle | | | | | | Linear Fit | |
| Toner | 1 | 2 | 3 | 4 | 5 | 6 | Intercept | Slope |
| 2A | 1.9 | 2.5 | 3.3 | 2.1 | 2.8 | 3.7 | 1.85 | 0.25 |
| 2B | 0 | 0 | 0 | 0 | 0 | 0 | 0.00 | 0.00 |
| 2C | 2.1 | 2.6 | 1.8 | 3.5 | 4.0 | 6.0 | 0.79 | 0.73 |
| 2D | 1.2 | 2.4 | 2.4 | 2.1 | 2.6 | 2.9 | 1.39 | 0.25 |
| 2E | 0 | 0 | 0 | 0 | 0 | 0 | 0.00 | 0.00 |

A quantitative measure of the degree of tacking can be obtained by transfer of the free surface treatment to the surface of a probe that is similar in nature to the core toner provided some method of separating the probe from the core is available. The free surface treatment will distribute uniformly over both the toner and probe surfaces will the tacked surface treatment will stay with the toner. The degree of tacking can be calculated from a bulk analysis such as x-ray fluorescence (XRF) or neutron activation for the surface treatment on the toner before and on both the toner and the probe after mixing and separation. The amount of transferred surface treatment and therefore the amount of tacked surface treatment can be calculated based upon the surface area of the toner and probe used in the mixing step.

Figure 1B:
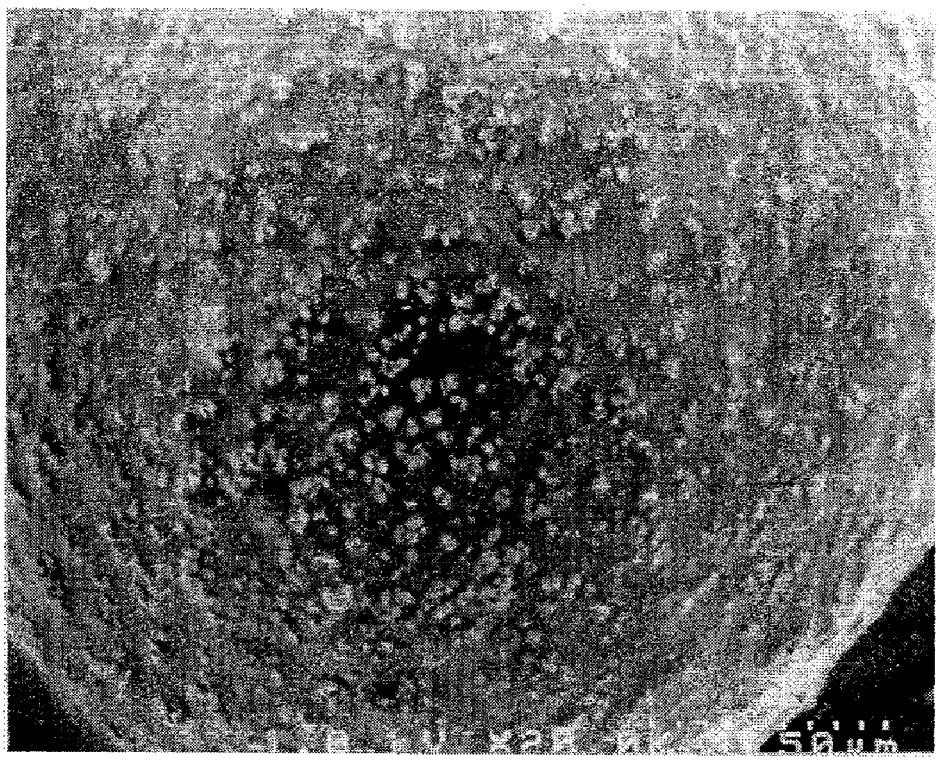
FIG. 1*b* is an SEM photomicrograph of spherical polymer bead probe after mixing with the toner of FIG. 1*a*.
Figure 2A:
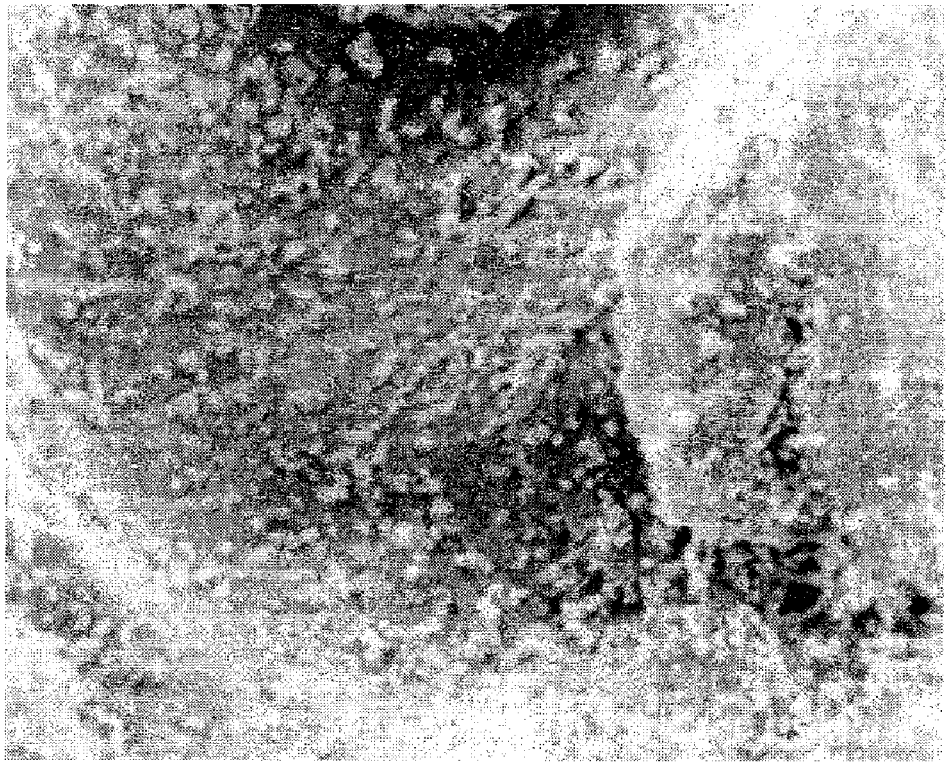
FIG. 2*a* is an SEM photomicrograph after mixing toner with a surface treatment wherein the surface treatment has been tacked to the toner and has not transferred upon mixing with a spherical polymer bead.
Figure 2B:
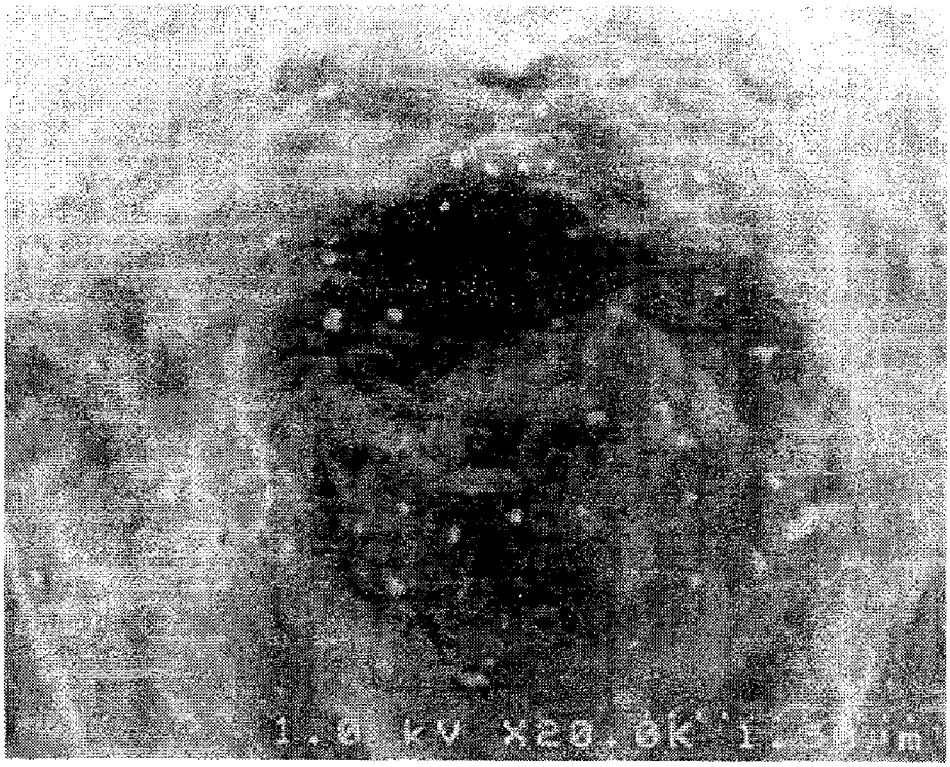
FIG. 2*b* is an SEM photomicrograph of spherical polymer bead probe after mixing with the toner of FIG. 2*a*.

One method of separation is to use a probe much different in size and separate the probe from the toner by some characteristic for analysis. FIGS. 1*a* (untacked) and 2*a* (tacked) show toners with surface treatment. FIG. 1*b* shows the transfer of surface treatment from a toner with free surface treatment to a probe of spherical polymer beads while FIG. 2*b* shows very little transfer of surface treatment from a toner having a surface treatment with a high degree of tacking. No size separation is perfect and cross contamination must be corrected for by either size or composition analysis of the starting and separated samples.

Another method of separation is by composition in a counting device such as the Horiba DP1000 Particle Analyzer. Single particles are sampled by the DP1000 and injected into a chamber as plasma. Four separate channels can be used analyze for fluorescence at four different wavelengths making it possible to evaluate the ratios of up to four different atoms in each particle. The distribution of the toner sampled by the DP1000 can be estimated by the cube root of the carbon signal, $C^{1/3}$. Since the surface treatment is spread over the surface, the ratio of the square root of the signal associated with the surface treatment to $C^{1/3}$ is proportional to the concentration of the surface treatment.

Table 3 shows results of analysis by a DP1000 Particle Analyzer to measure degree of surface treatments tacking of two toners as made and after aging in a developer station. Two toners were made by surface treating a polyester based core toner having a P.R. 57:1 colorant with 1.5% R972 from Degussa Corporation in a 75L Henschel mixer under the condition given below. Each was aged at 6% toner concentration using a 22 μm strontium ferrite carrier coated with 1.25% mixture of polyvinylidene fluoride and polymethylmethacrylate in a NexPress 2100 toning station run with replenishment using bias development against a nickel drum and a blade cleaner to recover the aged toner from the drum. The new and aged samples were mixed with equal parts a probe of untreated polyester toner having 15:3 as a colorant and having an equivalent surface area. The toner samples and mixtures were analyzed by the DP1000 Particle Analyzer using calcium from the P.R. 57:1 as a label for the toner particles and copper from the P.R.15:3 as a label for the probe particles. The surface treatment to polymer ratio $Si^{1/2}/C^{1/3}$ of the blends was used to calculate the transfer of the surface treatment to the probe toner and establish the degree of tacking.

TABLE 3

| | 75 L Henschel Conditions | | | Horiba DP1000 Parcticle Analyzer Surface treatment ratio $Si^{1/2}/C^{1/3}$ | | | |
|---|---|---|---|---|---|---|---|
| Toner | Time min. | Temp. C. | Test Toner Source | As is | Blend w/ Ca only | Blend w/ Cu only | % Tacked |
| 3A | 2.5 | 20 | New | 1.80 | 1.19 | 0.97 | 14.1% |
| | | | Aged | 1.76 | 1.6 | 0.6 | 30.4% |
| 3B | 25 | 42 | New | 1.74 | 1.56 | 0.65 | 28.1% |
| | | | Aged | 1.74 | 1.52 | 0.46 | 37.9% |

Other metal oxides have also been found to be useful as surface treatment agents to adjust charge level, humidity response, and cleaning performance. Among these are alumina, titanium dioxide also known as titania, zinc oxide, and cerium oxide. Alumina and titania were also found to function as flow aids when at least two of the dimensions are below 50 nm. These metal oxides may also be coated with alkyl silanes and silicone fluids and can be used as either the tacked or the free surface treatment component. Examples are isobutyl trimethoxy silane coated titania JMT150IB from Tayca Corporation, zinc oxide Z805 from Degussa Corporation, and silicone coated alumina BT0416 from Cabot Corporation.

Preferably, the toners are combined with a carrier to form a developer. Preferably, the average particle size ratio of carrier to toner particles is from about 15:1 to about 1:1. However, carrier-to-toner average particle size ratios of as high as about 50:1 can be useful. Preferably, the volume average particle size of the carrier particles can range from about 5 to about 50 microns.

U.S. Pat. Nos. 4,546,060 and 4,473,029, the disclosures of which are incorporated herein by reference, describe that the use of "hard" magnetic materials as carrier particles increases the speed of development dramatically when compared with carrier particles made of "soft" magnetic particles. The preferred ferrite materials disclosed in these patents include barium, strontium and lead ferrites having the formula $MO_6Fe_2O_3$ wherein M is barium, strontium or lead. However, magnetic carriers useful in the invention can include soft ferrites, hard ferrites, magnetites, sponge iron, etc. In addition, the magnetic carrier ferrite particles can be coated with a polymer such as mixtures polyvinylidenefluoride and polymethylmethacrylate or silicone resin type materials. Preferably, the toner is present in an amount of about 2 to about 20 percent by weight of the developer and preferably between 5 and 12 weight percent.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. An improved toner is disclosed that comprises a tacked or substantially fixed surface treatment and additional surface treatment(s) that is/are free to transfer. The fixed surface treatment provides an increased separation distance and reduced attractive force necessary in many electrophotographic process steps. The fixed surface treatment also reduces carrier scumming by the core toner and maintains a more consistent developer packed density.

The additional free surface treatment enhances the charging rate of the developer resulting in reduced dusting. The free surface treatment also acts to maintain the appropriate separation distance of the fixed surface treatment during low image content document print runs where long residence times can lead to embedment and engulfment. The free surface treatment properties are selected to maximize this protective effect. Typically, lower surface energy coatings such as silicone oil are used to treat metal oxides. Additional components can also be selected to improve the humidity response of the developer.

The following examples illustrate the practice of this invention. They are not intended to be exhaustive of all possible variations of the invention. Parts and percentages are by weight unless otherwise indicated.

EXAMPLES

Example 1

A blend of treated fumed silica was made by mixing 450 g of Aerosil R972 and 135 g of Aerosil RY200 from Degussa Corporation in a bag where the R972 was first deagglomerated by running through a 20 mm single screw feeder. Example 1 toner was made from 14.8 kg of a cyan core toner including polyester resin, pigment P.B. 15:3 provided as a flush in polyester by BASF and charge control agent of di-t-butylsalicylic acid zinc salt, and 200 g of the blended silicas. The surface treatment processing step was done in a 75L Henschel mixer. The toner and surface treatment were mixed for 20 minutes at 1745 RPM with active heating to obtain a temperature of 52° C. in 8 minutes and intermittent cooling thereafter to maintain a constant temperature. Comparative Example 1A toner was made in the same manner as Example 1 toner except 180 g of Aerosil R972 was used in place of the blended silicas. Comparative Example 1B toner was made in the same manner as Comparative Example 1A toner except the mixing conditions were 4 minutes with active cooling to maintain temperatures below 25° C. The formulations and processing conditions are summarized in Table 4A.

The degree of tacking was assessed by mixing with a 24 micron probe toner that had been classified 4 times in an ATP50 classifier from Hosokawa Micron Powder Systems to remove all fines below 14 microns. A 4-blade overhead mixer with a baffled pint jar was used to mix 35 g of example toner with 65 g of probe toner. The blend was mixed for 10 minutes at 5000 RPM and then separated by classifying in an MZR-100 classifier from Hosokawa Micron Powder Systems modified with a high efficiency cyclone at conditions that prevented the probe toner from contaminating the fines fraction containing the Example toner. The coarse fraction was passed through the classifier a second time to reduce the contamination by the Example toner. The separated toners were analyzed for surface treatment by XRF and the surface areas evaluated by Multisizer IIE from Beckman Coulter and the degree of tacking calculated. It is desired to have at least 25 percent of the surface area of the toner tacked with a metal oxide. More preferably, it is desired to have at least 40 percent on the surface are of the toner tacked with a metal oxide.

The performance was evaluated by testing in a developer life simulator having a ⅓ scale DigiMaster toning station and using bias development against a nickel drum with 82 g/hr replenishment. Developers were made with the toners at 6% toner concentration using a 22 μm strontium ferrite carrier coated with 1.25% mixture of polyvinylidene fluoride and polymethylmethacrylate. The developers were aged at various conditions for 35 hours over four days. The data were collected and averaged for another 4 days at 70° F. and 35% RH. Example 1 toner was found to have a high degree of tack but retained good dusting performance at a lower charge level than Comparative Example 1B toner where only of Aerosil R972 was used. Dusting performance was poor and the charge level lower for Comparative Toner 1A demonstrating the improved resistance to embedment by the free surface component Aerosil RY200 preventing transfer of the core toner material to the carrier surface. The embedment of the surface treatment of Comparative Example 1A toner by the Henschel mixer allowed the transfer of the core toner material to the carrier surface resulting in rapid developer aging yielding low charge levels and poor dusting performance. The performance is summarized in Table 4B.

Example 2

Example 2 toner was made by a continuous surface treatment process in a 100 ATP classifier from Hosokawa Micron Powder Systems by injecting 5 g/min of blended silica described in Example 1 into a 14 kg/hr stream of unclassified polyester cyan core toner of the composition in Example 1. The stream of unclassified core toner was simultaneous being produced on a 400 AFG fluidized bed jet mill from Hosokawa Micron Powder Systems. The combined toner and surface treatment stream was educated into the classifier at the centerline of the classifier at the plane of the tangential air disperser ring. The classifier was run at conditions to obtain the desired PSD as well as good dispersion of the surface treatment. In this type of process, surface treatment is lost to both the air stream and the high surface area of the fines. The capture rate of silica on the product was 64%.

Comparative Example 2 was made in the same manner as Example 2 except a stream of 4.2 g/min Aerosil R972 was feed and the dispersing and classifying air temperatures were lowered 11° C. The capture rate of silica on the product was 69%. The formulations and processing conditions are summarized in Table 4A.

The performance of these toners were evaluated in the same manner as Example 1 and is summarized in Table 4B. The degree of tacking in the ATP100 classifier is 30% for Example 2 toner and 44% for Comparative Example 2 toner. Good dusting performance was obtained at an acceptable charge level for Example 2 toner while the embedment of the surface treatment of Comparative Example 2 toner by the ATP100 classifier allowed the transfer of the core toner material to the carrier surface and rapid developer aging.

TABLE 4A

| Toner | Surface Treatement R972 | Surface Treatement RY200 | Process Conditions Device | Process Conditions Rate | Process Conditions Temp. C. |
|---|---|---|---|---|---|
| Example 1 | 1.03% | 0.31% | Henschel | 20 min. | 52 |
| Comp. Example 1A | 1.20% | | Henschel | 20 min. | 52 |
| Comp. Example 1B | 1.20% | | Henschel | 2.5 min. | 25 |
| Example 2 | 0.77% | 0.23% | ATP100 | 14 Kg/hr | 23 |
| Comp. Example 2 | 1.25% | | ATP100 | 14 Kg/hr | 12 |

TABLE 4B

| Toner | Surface Treatement Tacked | Surface Treatement Capture | Perf. at 35% RH Q/m | Perf. at 35% RH g/hr Dust |
|---|---|---|---|---|
| Example 1 | 61.4% | 100% | −40.2 | 0.008 |
| Comp. Example 1A | 69.0% | 100% | −30.0 | 0.030 |
| Comp. Example 1B | 5.1% | 100% | −48.5 | 0.010 |
| Example 2 | 30.3% | 64% | −49.7 | 0.012 |
| Comp. Example 2 | 43.9% | 69% | −44.0 | 0.047 |

Example 3

A Example 3 toner was made using 14.8 kg of a magenta core toner including polyester resin, pigment P.R. 57:1 provided as a flush in polyester by BASF and charge control agent of di-t-butylsalicylic acid zinc salt surface treated in a 75L Henschel mixer with 150 g of Aerosil R972 and 45 g of Aerosil RY200 from Degussa Corporation. The material was mixed at high speed (1745 RPM) for 10 minutes with active cooling followed by 20 minutes with active heating to achieve 125° F. in 6 minutes and intermittent cooling to maintain 125° F. for the remaining 14 minutes. The surface treated toner was sieved using a Sweco Vibro-Energy Separator with a 300 T mesh screen having a sonic dispersing ring.

Comparative Example 3 toner was made in a 200L Henschel mixer using 45 kg of core toner and 685 g of R972 and mixed for 4 minutes at 1140 RPM with active cooling to maintain a temperature below 80° F. The Example 3 toner was introduced to a prototype NexPress2100 machine that was running the Comparative Example 3 toner and in which the developer age had caused significant dusting in the magenta module. The dusting level was reduced to near new levels after 700 prints and contamination of the primary charger grids were greatly reduced. Table 5 summarizes specific image quality metrics of Example 3 toner showing improved performance in metrics of background and satellites. Background is a measurement that is used to characterize the non-image area coverage with toner as described by Dooley and Shaw, *J. Appl. Photogr. Eng.* 5:190-196 (1979) and modified for color perception with weighting factors of 1.00 for black, 0.63 for cyan, 0.86 for magenta, and 0.30 for yellow as outlined in *ImageXpert User Manual v9.2 p* 9-19 (May 2002). Satellites are a measure of the propensity of toner to be developed or jump from the image to the non-image area next to an image. Satellites is the background measured inside the non-image area of the capital letter N. Decreasing cohesiveness of the toner has been found to increase satellites while decreasing grain as defined by Bouk and Burningham, *Eighth International Congress on Advances in Non-Impact Printing Technologies,* 506 (1992). Background was reduced by 0.3 and satellites 0.4 units with no significant increase in grain. The sensitivity to job stream was evaluated by running 300 tabloid sized prints having a nominal image content followed by 600 tabloid sized prints that were blank and monitoring the process control voltage Vo as it rose to maintain constant density. The rise in Vo while printing the blanks was 20 volts for Example 3 toner and 60 volts for Comparative Example 3 toner.

TABLE 5

| | Example 3 Cleaned | Example 3 0.5K | Comp. Example 3 Cleaned | Comp. Example 3 0.5K |
|---|---|---|---|---|
| Grain | 25.9 | 26.0 | 25.4 | 25.9 |
| Satellites | 1.54 | 1.58 | 1.86 | 1.97 |
| Background | 1.84 | 1.37 | 2.28 | 1.53 |

Example 4

Two P.R. 57:1 magenta toner formulas were prepared in a 75L Henschel mixer under the following conditions with a cold start and a hot start condition shown in shown in the table below resulting in 4 toners for each formula for a total of 8 toners: The temperature was increased slightly for the inventive formulas with RY200 in order to result in approximately the same charge level. The formulas and process conditions are summarized in Table 6A.

These toners were tested in a developer life simulator at a constant toner usage rate. Very low dusting was found for all eight toners demonstrating the value of tacking the surface treatment to prevent mass transfer of toner material to the charging surface of the carrier. The testing also found that the higher temperature at shorter times gave equivalent performance but the greater temperatures for the formulas with both Aerosil R972 and RY200 reduced the Q/m more than it was increased by the addition of RY200. The toner Q/m's between cold and hot start conditions during processing were about four times more consistent during the developer break-in for toners made with addition of RY200. This improvement can be seen in Table 6B as the increased signal-to-noise (S/N) calculated from the variability in Q/m over the first tens hours of the developer life for both the cold and hot initial processing conditions.

TABLE 6A

| Toner | Formula R972 | Formula RY200 | Process Conditions Starting ° C. | Process Conditions Time Min. | Process Conditions Final ° C. | Mean Q/m μC/g 1st 10 hrs | Mean Q/m μC/g All |
|---|---|---|---|---|---|---|---|
| Example 4A | 1.0% | 0.3% | 25 | 20 | 47 | −45.2 | −43.3 |
| Example 4B | | | 38 | | | −41.3 | −42.6 |

TABLE 6A-continued

| | Formula | | Process Conditions | | | Mean Q/m μC/g | |
|---|---|---|---|---|---|---|---|
| Toner | R972 | RY200 | Starting ° C. | Time Min. | Final ° C. | 1st 10 hrs | All |
| Example 4C | | | 25 | 10 | 53 | −44.0 | −44.9 |
| Example 4D | | | 42 | | | −45.5 | −43.7 |
| Comp. Example 4A | 1.5% | 0.0% | 26 | 20 | 42 | −46.0 | −45.0 |
| Comp. Example 4B | | | 37 | | | −55.3 | −50.1 |
| Comp. Example 4C | | | 26 | 10 | 47 | −48.3 | −48.4 |
| Comp. Example 4D | | | 102 | | | −51.6 | −51.2 |

TABLE 6B

| | | Signal to Noise db | |
|---|---|---|---|
| Factor | Mean Q/m | All | Starting ° |
| Example 4 | 43.6 | 19.8 | 36.2 |
| Comp. Example 4 | 48.7 | 18.7 | 25.2 |
| Cooler/Long | 45.2 | 18.2 | 30.2 |
| Hotter/Short | 47.1 | 20.3 | 31.2 |

Example 5

A four-color set of black, yellow, magenta, and cyan toner was made with the formula of 14.7 Kg core toner, 190 g of Degussa Aerosil R972, and 63 g of Degussa Aerosil RY200. The material was mixed at high speed (1745 RPM) for 10 minutes with active heating to achieve 135° F. in 6 minutes and intermittent cooling to maintain 135° F. for the remaining 4 minutes. These toners were tested on a NexPress2100 machine with a low image content and low duty cycle job stream. Under these conditions standard toners based on R972 silica only and cold processing conditions in the surface treatment blender exhibited low Q/m and failures and heavy dusting at 70 to 200K of developer life. Example 5 toners were added at between 100,000 and 160,000 print developer life. The developers recovered with lower dusting and a 25% increase in the toning potential required to obtain the target density, thus eliminating the low Q/m failures. The developer showed no sign of aging to 500K for black, yellow, and cyan. The magenta was replaced at 268K for other reasons and a toner of formula and processing conditions used for Example 3 toner in Table 5 was added to show the effect of surface treatment level on performance. The toning potential required to obtain target density was reduced by 15%.

Example 6

Two samples each of cyan and magenta toners having pigment PB 15:3 and P.R. 57:1 as colorants were surface treated as in Example 1 using either 63 or 112 g of Degussa Aerosil RY200 and 150 g Degussa Aerosil R972 on 14.7 Kg of core toner and tested for 40K in a production NexPress21100 machine. Both toners of the higher RY200 formulas increased the Q/m by 6% with no change in image quality, fogging, or machine contamination. This increase in Q/m resulting in high electrophotographic set points and demonstrates the desirable property of a formula to adjust charge level.

Example 7

A magenta having P.R. 122 as a colorant was treated with 150 g of Degussa Aerosil R972 and 4 g of Degussa Aerosil RY200 according to the process Example 3 and run on a production NexPress2100 machine. P.R. 122 has a positive tribocharging characteristic that causes greater machine contamination than P.R. 57:1. A significant reduction of contamination was observed by the combination of surface treatment and heated process and this reduction of contamination allowed maintenance intervals greater than those required for toners using P.R. 57:1 before contamination affects image quality and thus increasing the up time of the press.

Example 8

Example 8 toner was made using a cyan polyester core toner having P.B. 15:3 as a colorant by surface treating with 1.05% Aerosil R972 and 0.32% Aerosil RY200 in a 10 L Henschel mixer at 3000 RPM mixer speed and a load of 2.5 Kg. Comparative Example 8A toner was made with the same formula and conditions except processing for 2 minutes with active cooling to keep the temperature at 25° C. Comparative Example 8B toner was made with the same conditions as Comparative Example 8A but with 1.5% Aerosil R972 only to obtain an equivalent surface treatment coverage.

These toners were tested in the developer life simulator device described in Example 1 at a constant toner usage over extremes of humidity and temperature using a strontium ferrite carrier coated at 1.25% with a mixture of polyvinylidene fluoride and polymethylmethacrylate in a ratio of 60 to 40. Example 8 toner ran at charge level similar to Comparative Example 8C but had lower dusting in both early developer life and at high humidity where dusting performance of Comparative Example 8C toner was poor. Increasing the charge level by increasing the Aerosil R972 in Comparative Example 8B toner improved the dusting performance but resulted in high charge level. Comparative Example 8A toner gave acceptable dusting performance but had an unacceptably high charge level. The heating processing of Example 8 toner lowered the charge by 25% to a level similar to Comparative Example 8C toner while maintaining the improved dusting performance. Table 7 summarizes the formula, process conditions and performance for these toners.

TABLE 7

| Toner | R972 | RY200 | Henschel Conditions Scale | Time min. | Temp. C. | Q/m μC/g | Dust g/hr |
|---|---|---|---|---|---|---|---|
| Example 8 | 1.05% | 0.32% | 10 L | 10 min | 52 | −42.6 | 0.015 |
| Comparartive Example 8A | 1.05% | 0.32% | 10 L | 2 min | 25 | −57.1 | 0.016 |
| Comparartive Example 8B | 1.50% | | 10 L | 2 min | 25 | −53.3 | 0.039 |
| Comparartive Example 8C | 1.20% | | 200 L | 6 min | 25 | −45.8 | 0.058 |

Example 9

Four polyester cyan toners were made with high levels of tack and free surface components along with the addition of a third surface treatment component to lowered the charge level and maintain performance over a wide humidity range. Example 9A-9D toners with three surface treatment components were prepared in 2.5 Kg batches on a 10 L Henschel mixer at 3000 RPM mixer speed 7.5 minutes starting at 22° C. and reaching 52° C. by 4 minutes with cooling to maintain 52° C. thereafter. Each toner had 1.35% R972 and 0.50% RY200, along with 0.75% of a varied zinc oxide component. The zinc oxide in Example 9A toner was NanoTek Zinc Oxide from Nanophase Technologies Corporation, that Example 9B toner was MZ-500 from Tayca Corporation, that in Example 9C toner was AdNano Z20 from Degussa Corporation, and that in the Example. 9D toner was octyltrimethoxy silane treated Z805 from Degussa Corporation. The formulations and processing conditions are summarized in Table 8A These toners were tested in a developer life simulator as described in Example 1 at a constant toner usage over extremes of humidity and temperature using a strontium ferrite carrier coated at 1.25% with a mixture of polyvinylidene fluoride and polymethylmethacrylate in a ratio of 20 to 80. Heat was applied to the toning stations to maintain 100° F. It was found through previous testing that the charge-to-mass depended only upon the dew point at running equilibrium so the tests were compared to previous controls run without the station being heated as in Example 8. All of the inventive toners in this Example reduce the humidity sensitivity by one half relative to comparative toners 8A, 8B and 8C as shown by the ratio of the charge level at dew point of 20° F. to that at 70° F. given in the column labeled 20/70 in the Table 8B below. Each toner had low dusting while the uncoated zinc oxide allowed lower charge levels at higher silica coverage while maintaining the desired charge level and humidity sensitivity.

TABLE 8A

| Toner | Tacked R972 | Free RY200 | ZnO for RH & Q/m Level | Type | Henschel Conditions Scale | Time min. | Temp. C. |
|---|---|---|---|---|---|---|---|
| Example 9A | 1.35% | 0.50% | 0.75% | NanoTek | 10 L | 7.5 | 52 |
| Example 9B | 1.35% | 0.50% | 0.75% | MZ-500 | 10 L | 7.5 | 52 |
| Example 9C | 1.35% | 0.50% | 0.75% | AdNano Z20 | 10 L | 7.5 | 52 |
| Example 9D | 1.35% | 0.50% | 0.75% | AdNano Z805 | 10 L | 7.5 | 52 |

TABLE 8B

| Toner | Q/m μC/g | Dust g/hr | 20/70 |
|---|---|---|---|
| Example 9A | −44.9 | 0.013 | 1.38 |
| Example 9B | −49.5 | 0.004 | 1.28 |
| Example 9C | −41.4 | 0.018 | 1.32 |
| Example 9D | −61.1 | 0.009 | 1.21 |
| Example 8 | −42.6 | 0.015 | 1.37 |
| Comparartive Example 8A | −57.1 | 0.016 | 1.66 |
| Comparartive Example 8B | −53.3 | 0.039 | 1.94 |
| Comparartive Example 8C | −45.8 | 0.058 | 1.72 |

Example 10

Example 10 toner was made and tested according to Example 9 where isobutyl trimethoxy silane treated titania JMT150IB from Tayca Corporation was used as the third surface treatment component. This titania has a surface area of 130 $mg^2/g$ and is acicular in form with an aspect ratio greater than 2. Excellent charging, dusting, humidity performance were obtained. Example 10 toner exhibits desired charge level with improved humidity performance compared to toners in Example 9.

TABLE 9

| Toner | Tacked R972 | Free RY200 | Third Component Type | Third Component Level | Q/m μC/g | Dust g/hr | 20/70 |
|---|---|---|---|---|---|---|---|
| Example 10 | 1.35% | 0.50% | 0.50% | $TiO_2$ JMT150IB | −44.0 | 0.008 | 1.15 |
| Example 9A | 1.35% | 0.50% | 0.75% | ZnO NanoTek | −44.9 | 0.013 | 1.38 |
| Example 9D | 1.20% | 0.50% | 0.75% | ZnO AdNano Z805 | −61.1 | 0.009 | 1.21 |

Example 11

Example 11 toner was made using 18.7 Kg of a polyester cyan toner with 95 g of alkyl silane treated titania JMT150IB and 171 g of Aerosil RY200 and was surface treated in a 75L Henschel mixer for 10 minutes starting at 22° C. and reaching 52° C. by 4 minutes with cooling to maintain 52° C. thereafter. In this Example, the titania has a surface energy of 34 ergs/cm$^2$ and acts as the tacked surface treatment as well as a modifier of charge level and humidity sensitivity. Excellent charging, dusting, humidity performance were obtained with equivalent performance of the three component Example 10 toner and much improved performance over the Example 8 and Comparative Example 8A toners. The formula, process conditions and performance are given in Table 10.

TABLE 10

| Toner | Tacked Treatment Type | Tacked Treatment Level | Free Treatment Type | Free Treatment Level | Q/m μC/g | Dust g/hr | 20/70 |
|---|---|---|---|---|---|---|---|
| Example 11 | JMT150IB | 0.50% | RY200 | 0.90% | −46.7 | 0.022 | 1.11 |
| Example 8 | R972 | 1.05% | Ry200 | 0.32% | −42.6 | 0.015 | 1.37 |
| Comparative Example 8A | | | R972 | 1.20% | −45.8 | 0.058 | 1.72 |

The invention has been described in detail with particular reference to certain preferred embodiments thereof, but it will be understood that variations and modifications can be effected within the spirit and scope of the invention.

The invention claimed is:

1. A developer for developing electrostatic images comprising:

magnetic carrier particles at 60 to 99 weight percent of the developer;

toner particles at 1 to 40 weight percent of the developer, wherein said toner particles comprise:

resin core particles having outer surfaces, first metal oxide particles comprising from 0.05 to 5 weight percent of the toner particles that are tacked to the outer surfaces but not completely embedded into the resin core particles, and second metal oxide particles comprising from 0.05 to 2 weight percent of the toner particles that are free to transfer between the outer surface of the toner particles and an outer surface of the magnetic carrier particles.

2. The developer of claim 1 wherein said resin core particles are selected from the group consisting of condensation polymers, copolymers of styrene, copolymers of lower alkyl styrenes with acrylic monomers, and polyesters and mixtures thereof.

3. The developer of claim 1 wherein said toner particles further comprises charge control agents, waxes or colorants.

4. The developer of claim 1 wherein the magnetic carrier particles comprise strontium ferrite.

5. The developer of claim 1 wherein the first metal oxide particles are selected from the group consisting of silica, titania and alumina.

6. The developer of claim 1 wherein the first metal oxide particles have a particle size of from 7 to 70 nm.

7. The developer of claim 1 wherein the first metal oxide particles have been surface coated.

8. The developer of claim 7 wherein the surface treatment comprises a coating of polydimethylsiloxane, hexamethyldisilazane, dimethyldichlorosilane and other alkyl silanes.

9. The developer of claim 1 wherein the second metal oxide particles are selected from the group consisting of silica, alumina, titania and ceria.

10. The developer of claim 1 wherein the second metal oxide particles have a particle size of from 7 to less than 55 nm.

11. The developer of claim 1 wherein the second metal oxide particles have been surface coated.

12. The developer of claim 11 wherein the surface treatment comprises a coating of polydimethylsiloxane, hexamethyldisilazane, dimethyldichlorosilane and other alkyl silanes.

13. The developer of claim 1 wherein a ratio of an average particle size of carrier to toner particles is from 15:1 to about 1:1.

14. The developer of claim 1 wherein the first metal oxide particles have been tacked to at least 25 percent of the outer surfaces of the toner particles.

15. The developer of claim 1 further comprising third metal oxide particles that are free to transfer between the outer surfaces of the toner particles and an outer surface of the magnetic carrier surface.

16. The developer of claim 1 further comprising third metal oxide particles that are tacked to the outer surfaces of the toner particles.

17. The developer of claim 1 wherein the first metal oxide particles have a surface energy that is relatively higher than that of the second metal oxide particles.

18. A method for forming the developer of claim 17, comprising simultaneously surface treating the resin core particles with a mixture of the first and second metal oxide particles under conditions of sufficient mechanical forces and temperature to cause substantial tacking of the higher surface energy first metal oxide particles to the surfaces of the resin core particles while the second metal oxide particles remain free to move and transfer to other surfaces to form surface treated toner particles, and combining the surface treated toner particles with the magnetic carrier particles.

19. A toner comprising toner particles comprising:

resin core particles having outer surfaces, first metal oxide particles comprising from 0.05 to 5 weight percent of the toner particles that are tacked to the outer surfaces but not completely embedded into the resin core particles, and second metal oxide particles comprising from 0.05 to 2 weight percent of the toner particles that are not tacked to the outer surfaces of the resin core particles.

20. The toner of claim 19 wherein the first metal oxide particles have a surface energy that is relatively higher than that of the second metal oxide particles.

21. A method for forming the toner of claim 20, comprising simultaneously surface treating the resin core particles with a mixture of the first and second metal oxide particles under conditions of sufficient mechanical forces and temperature to cause substantial tacking of the higher surface energy first metal oxide particles to the surfaces of the resin core particles while the second metal oxide particles remain free to move and transfer to other surfaces.

* * * * *